US010604373B2

(12) United States Patent
Kodama et al.

(10) Patent No.: US 10,604,373 B2
(45) Date of Patent: Mar. 31, 2020

(54) RECORDING SYSTEM

(71) Applicant: SEIKO EPSON CORPORATION, Tokyo (JP)

(72) Inventors: Hidetoshi Kodama, Nagano (JP); Tomohiro Yasufuku, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/944,968

(22) Filed: Apr. 4, 2018

(65) Prior Publication Data

US 2018/0311975 A1 Nov. 1, 2018

(30) Foreign Application Priority Data

Apr. 28, 2017 (JP) ..... 2017-089863
May 16, 2017 (JP) ..... 2017-097324

(51) Int. Cl.

| | |
|---|---|
| ***B65H 33/12*** | (2006.01) |
| ***B41J 13/00*** | (2006.01) |
| ***B65H 29/60*** | (2006.01) |
| ***B65H 29/12*** | (2006.01) |
| ***B41J 13/03*** | (2006.01) |
| ***B65H 9/00*** | (2006.01) |
| ***B65H 85/00*** | (2006.01) |
| *B41J 11/00* | (2006.01) |

(52) U.S. Cl.

CPC ..... *B65H 33/12* (2013.01); *B41J 13/0009* (2013.01); *B41J 13/009* (2013.01); *B41J 13/03* (2013.01); *B65H 9/006* (2013.01); *B65H 29/125* (2013.01); *B65H 29/60* (2013.01); *B65H 85/00* (2013.01); *B41J 11/0015* (2013.01); *B65H 2301/33312* (2013.01); *B65H 2301/4452* (2013.01); *B65H 2301/4453* (2013.01); *B65H 2301/517* (2013.01); *B65H 2402/10* (2013.01); *B65H 2513/108* (2013.01); *B65H 2801/06* (2013.01); *B65H 2801/15* (2013.01)

(58) Field of Classification Search

CPC .. B65H 29/60; B65H 2513/108; B65H 33/12; B65H 2301/351

See application file for complete search history.

(56) References Cited

U.S. PATENT DOCUMENTS

| | | | | |
|---|---|---|---|---|
| 5,358,464 | A * | 10/1994 | Funk | B65H 29/60 198/341.03 |
| 6,450,711 | B1 * | 9/2002 | Conrow | B65H 15/00 400/582 |
| 9,682,834 | B2 * | 6/2017 | Kodama | B65H 29/60 |
| 2006/0214974 | A1 * | 9/2006 | Isobe | B41J 29/377 347/18 |
| 2015/0151944 | A1 | 6/2015 | Shirasaki et al. | |
| 2015/0352870 | A1 * | 12/2015 | Imafuku | B41J 13/0009 347/5 |
| 2016/0116881 | A1 * | 4/2016 | Kodama | B65H 29/60 358/498 |
| 2016/0280495 | A1 | 9/2016 | Kodama et al. | |

FOREIGN PATENT DOCUMENTS

| | | |
|---|---|---|
| JP | 2015-107840 A | 6/2015 |
| JP | 2016-185867 A | 10/2016 |

* cited by examiner

*Primary Examiner* — Howard J Sanders
(74) *Attorney, Agent, or Firm* — Global IP Counselors, LLP

(57) ABSTRACT

There is provided a recording system that can suppress a reduction in throughput when post-processing is performed in a post-processing apparatus.

9 Claims, 10 Drawing Sheets

RECORDING SYSTEM

BACKGROUND

1. Technical Field

The present invention relates to a recording system including a recording unit that performs recording by ejecting liquid onto a medium to be transported, and a post-processing unit that performs post-processing for the medium that is sent after recording is performed by the recording unit.

2. Related Art

In the related art, there is a known recording system that includes a recording apparatus (image forming apparatus) having a recording unit which ejects ink (liquid) onto paper that is an example of a medium to record an image, and a post-processing apparatus that performs post-processing such as punching processing or stapling processing for paper on which an image is recorded.

JP-A-2016-185867 discloses a configuration of a recording apparatus (printer 100 in JP-A-2016-185867) such as a printer recording an image on paper, a post-processing apparatus (post-processing apparatus 300 in JP-A-2016-185867) including a post-processing unit that performs post-processing on paper on which an image is recorded, and a relay unit (transport apparatus 200 in JP-A-2016-185867) configuring a transport path between the recording apparatus and the post-processing apparatus, as the recording system.

The post-processing apparatus performs post-processing such as punching processing or stapling processing for the paper on which recording is performed in the recording apparatus.

Specifically, the recording apparatus continuously performs recording on a plurality of sheets of paper, continuously sends the recorded paper to the post-processing apparatus via the relay unit, stacks a plurality of sheets of paper in the post-processing unit of the post-processing apparatus, and performs the post-processing for the stacked paper bundle.

Here, in a case where a plurality of sheets of recorded paper are continuously sent, a preceding medium that is sent earlier and a succeeding medium subsequent to the preceding medium are sent at an interval so as not to collide with each other.

In a case where a plurality of sheets of paper are stacked in an overlapped manner in the post-processing unit and the post-processing is performed, a relatively large interval is required between the preceding medium and the succeeding medium for a stacking operation and a post-processing operation, for example, as compared with a case where the recorded papers are stacked on a discharge tray in an overlapped manner as it is.

When post-processing is performed in the post-processing unit, if the paper on which recording is performed in the recording apparatus is transported to the post-processing apparatus via a relay unit at a wide interval between the preceding medium and the succeeding medium, processing speed (throughput) per unit time in the recording system decreases, for example, as compared with a case where post-processing is not performed.

SUMMARY

An advantage of some aspects of the invention is to provide a recording system capable of suppressing a reduction in throughput when post-processing is performed in a post-processing apparatus.

According to an aspect of the invention, a recording system includes a relay transport path through which a medium is transported between a recording unit that performs recording by ejecting liquid onto the medium, and a post-processing unit that performs post-processing for the medium on which recording is performed by the recording unit, and. In the relay transport path, a preceding medium which is transported earlier and a succeeding medium which is transported subsequently to the preceding medium are transported with an interval. In the relay transport path, the interval between the preceding medium and the succeeding medium is widest in a transport region on a downstream side in a medium transport direction before the preceding medium enters into the post-processing unit.

In this configuration, an interval between the preceding medium and the succeeding medium in the relay transport path is widest in a transport region on a downstream side in a medium transport direction before the preceding medium enters into the post-processing unit, that is, the interval between the preceding medium and the succeeding medium is widest on a side close to the post-processing unit, and thus, while the interval between the preceding medium and the succeeding medium necessary for post-processing is secured immediately before the post-processing unit, the interval is shortened on an upstream side of the relay transport path, and thereby, it is possible to suppress a reduction in throughput of the recording system.

The recording system may further include a correction transport unit that is provided in the relay transport path and to which a leading edge of the medium is butted to perform a skew correction operation and then to transport the medium. An interval between the preceding medium and the succeeding medium may be widest on a downstream side of the correction transport unit in a medium transport direction.

If a skew correction operation is performed for the preceding medium in the correction transport unit to which a leading edge of the medium is butted, an interval between the preceding medium and a succeeding medium is shortened, but in this case, the interval between the preceding medium and the succeeding medium is widest on a downstream side of the correction transporting unit in a medium transport direction, and thus, it is possible to secure the interval between the preceding medium and the succeeding medium on an upstream side of the post-processing unit and to send the medium whose posture is corrected by the correction transport unit to the post-processing unit.

The relay transport path may include a first transport path that is provided on an upstream side, a second transport path that is connected to the first transport path on a downstream side in a medium transport direction and includes the correction transport unit, and a third transport path that is connected to the second transport path on a downstream side in a medium transport direction. An average medium transport speed in the third transport path may be faster than an average medium transport speed in the second transport path, and the average medium transport speed in the second transport path may be faster than an average medium transport speed in the first transport path.

In this configuration, since an average medium transport speed in the second transport path including the correction transport unit is faster than an average medium transport speed in the first transport path, an interval between a preceding medium and a succeeding medium is shortened when a skew correction operation is performed by the correction transport unit for the preceding medium, and thus, it is possible to suppress a possibility that the succeeding medium collides with the preceding medium.

In addition, in the relay transport path, an average medium transport speed in the third transport path located on a downstream side is faster than an average medium transport speed in the second transport path, and thus, it is possible to realize a configuration in which the interval between the preceding medium and the succeeding medium is widest on a downstream side of the relay transport path.

The first transport path may include a branch path that is provided on an upstream side in a medium transport direction, a first switchback path that is one branch destination of the branch path and performs a switchback operation for reversing a transport direction of the medium, a second switchback path that is another branch destination of the branch path and performs a switchback operation for reversing the transport direction of the medium, a first inversion path through which the medium after the switchback operation in the first switchback path is sent, a second inversion path through which the medium after the switchback operation in the second switchback path is sent, and a confluence path in which the first inversion path and the second inversion path are joined and which is connected to the second transport path.

In this configuration, the first transport path branches on an upstream side in a medium transport direction and includes two paths passing through a switchback path and an inversion path and includes a confluence path where the two paths are joined, and thereby, a preceding medium and a succeeding medium can be transported alternately in the two paths. By doing so, media can be transported at a shortened interval between the preceding medium and the succeeding medium in the first transport path, and thereby, throughput in the recording system can be improved. In addition, since the relay transport path can be formed long, drying time of a recorded medium can be lengthened.

The recording system may further include a plurality of pairs of transport rollers that transport the medium through the second transport path. An interval between the preceding medium and the succeeding medium when a trailing edge of the preceding medium is located at a position of a pair of downstream transport rollers that is located on a most downstream side among the plurality of pairs of transport rollers may be wider than an interval between the preceding medium and the succeeding medium, when a leading edge of the preceding medium is located at a position of a pair of upstream side transport rollers that is located at a most upstream side among the plurality of pairs of transport rollers.

In this configuration, when the preceding medium exits from the second transport path, an interval between the preceding medium and the succeeding medium is wider than an interval between the preceding medium and the succeeding medium when the preceding medium enters into the second transport path, and thereby, it is possible to realize a configuration in which the interval is widest on a downstream side of the relay transport path.

The recording system may further include a recording mechanism unit that includes the recording unit, a post-processing mechanism unit that includes the post-processing unit, and a relay mechanism unit that is disposed between the recording mechanism unit and the post-processing mechanism unit and includes at least a part of the relay transport path.

In this configuration, the recording system including the recording mechanism unit, the post-processing mechanism unit, and the relay mechanism unit can obtain the same effects as the above-described configurations.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

Hereinafter, embodiments of the invention will be described with reference to the drawings.

Figure 1:
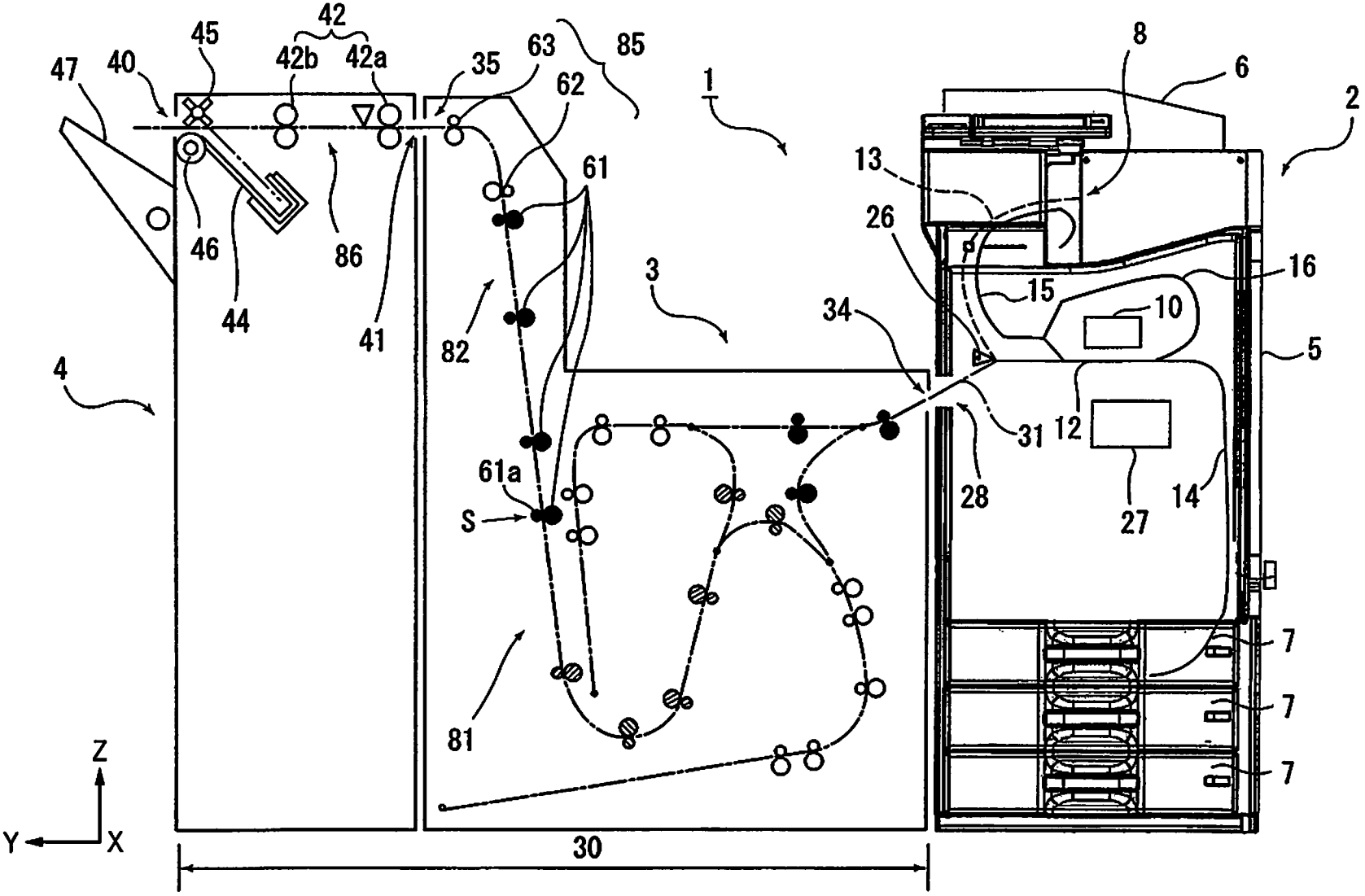
FIG. 1 is a schematic view of a recording system according to the invention.
Figure 2:
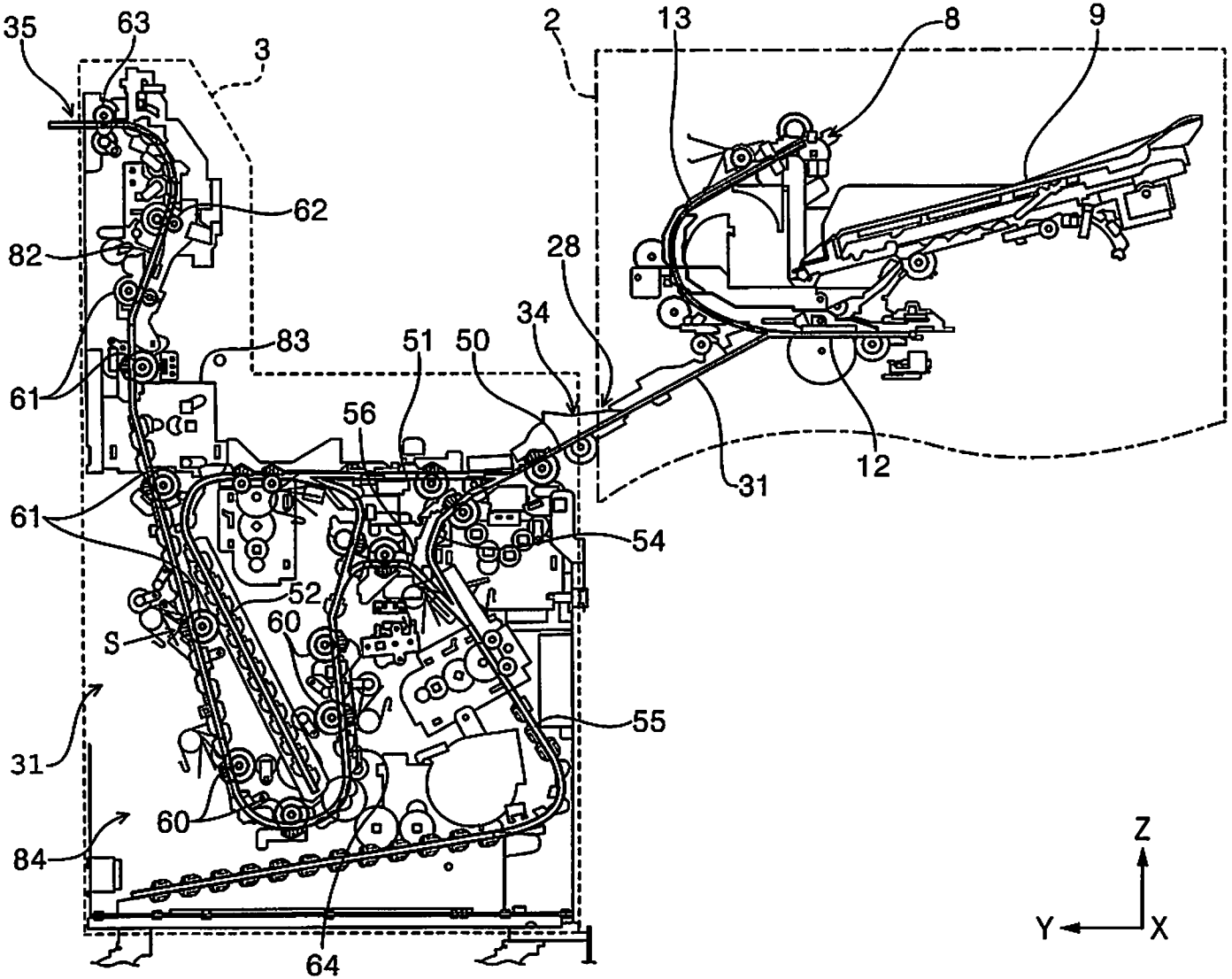
FIG. 2 is a side sectional view of a part of a recording mechanism unit and a relay mechanism unit.
Figure 3:
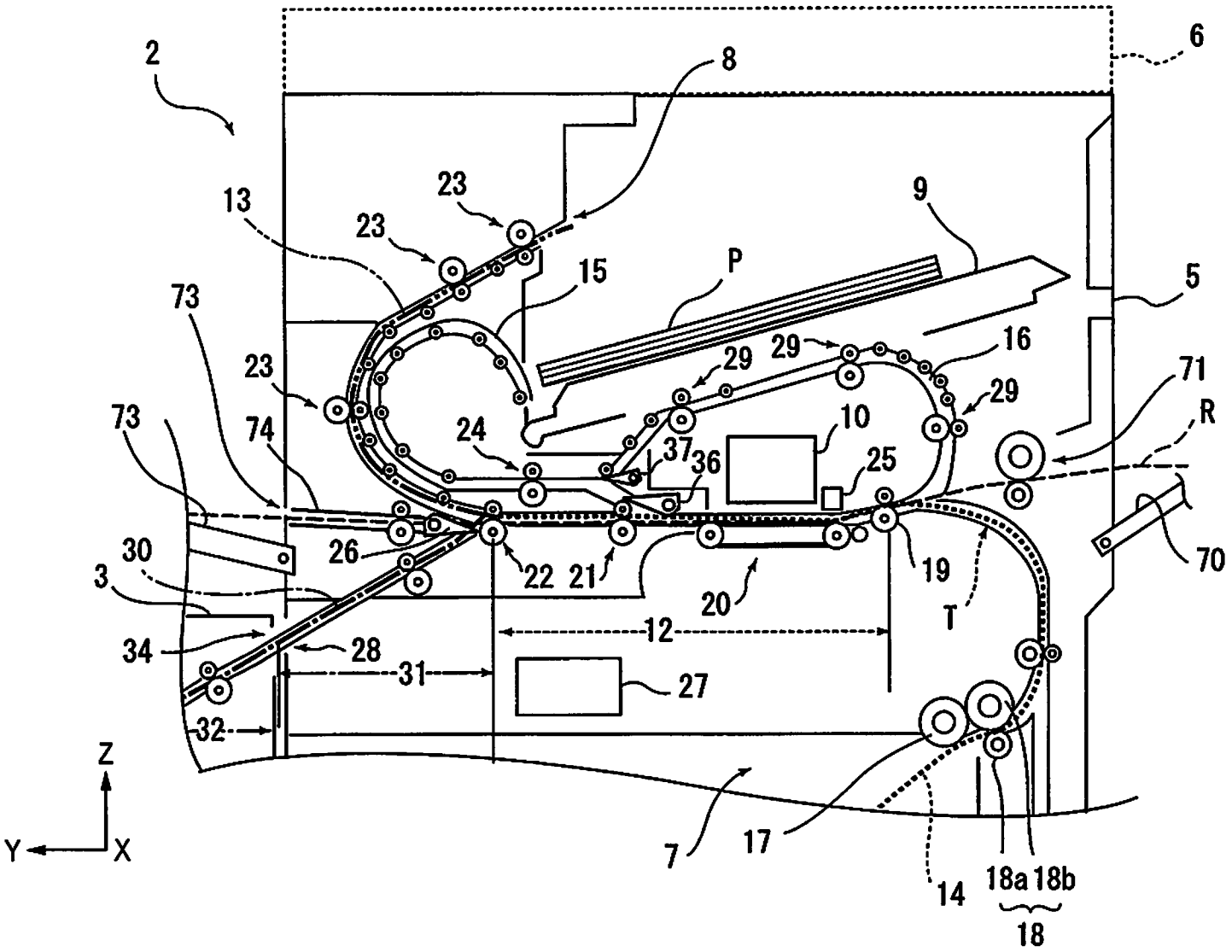
FIG. 3 is a schematic view illustrating transport paths of the recording mechanism unit.
Figure 4:
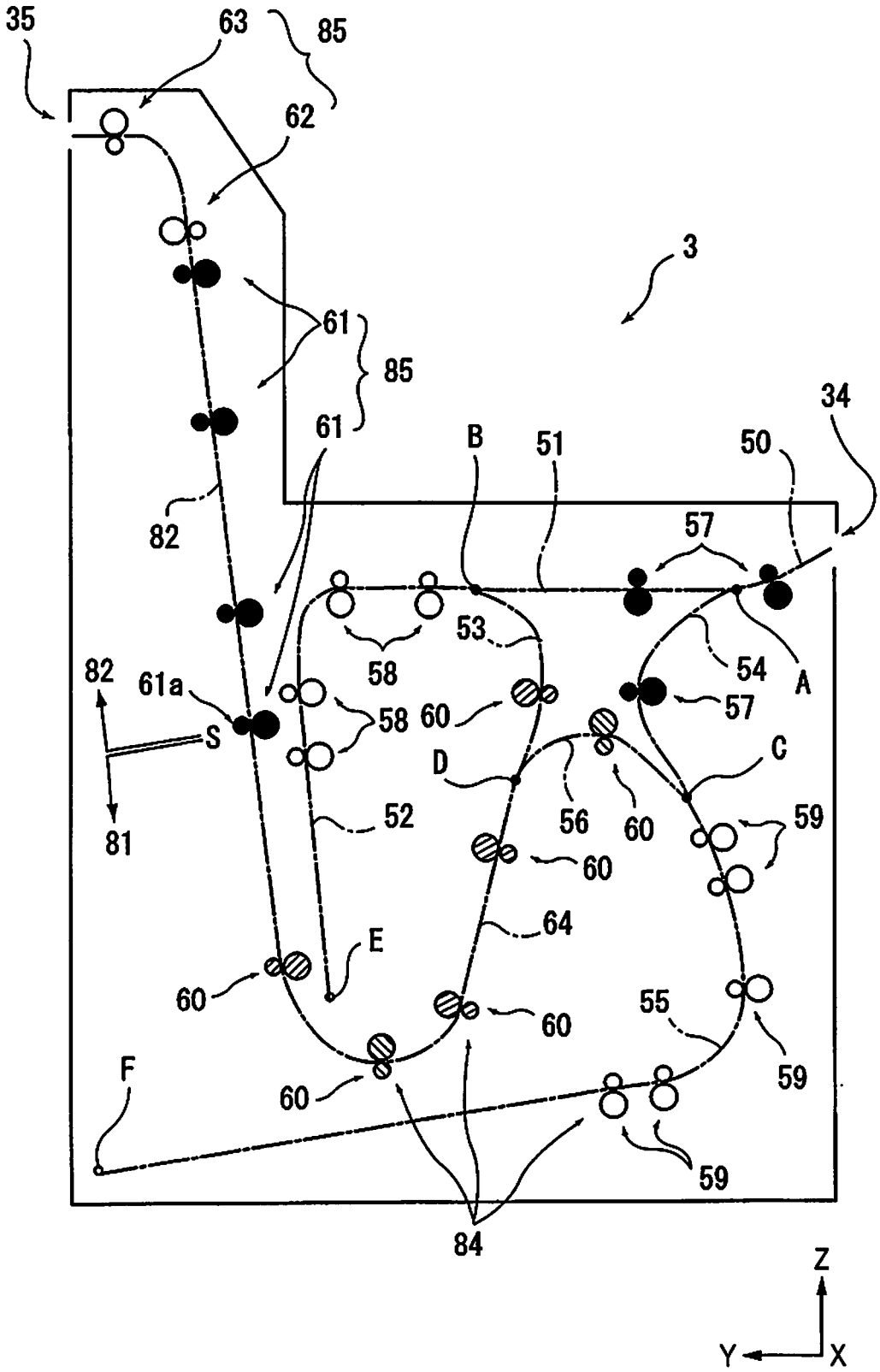
FIG. 4 is a schematic diagram illustrating transport paths of the relay mechanism unit.
Figure 5:
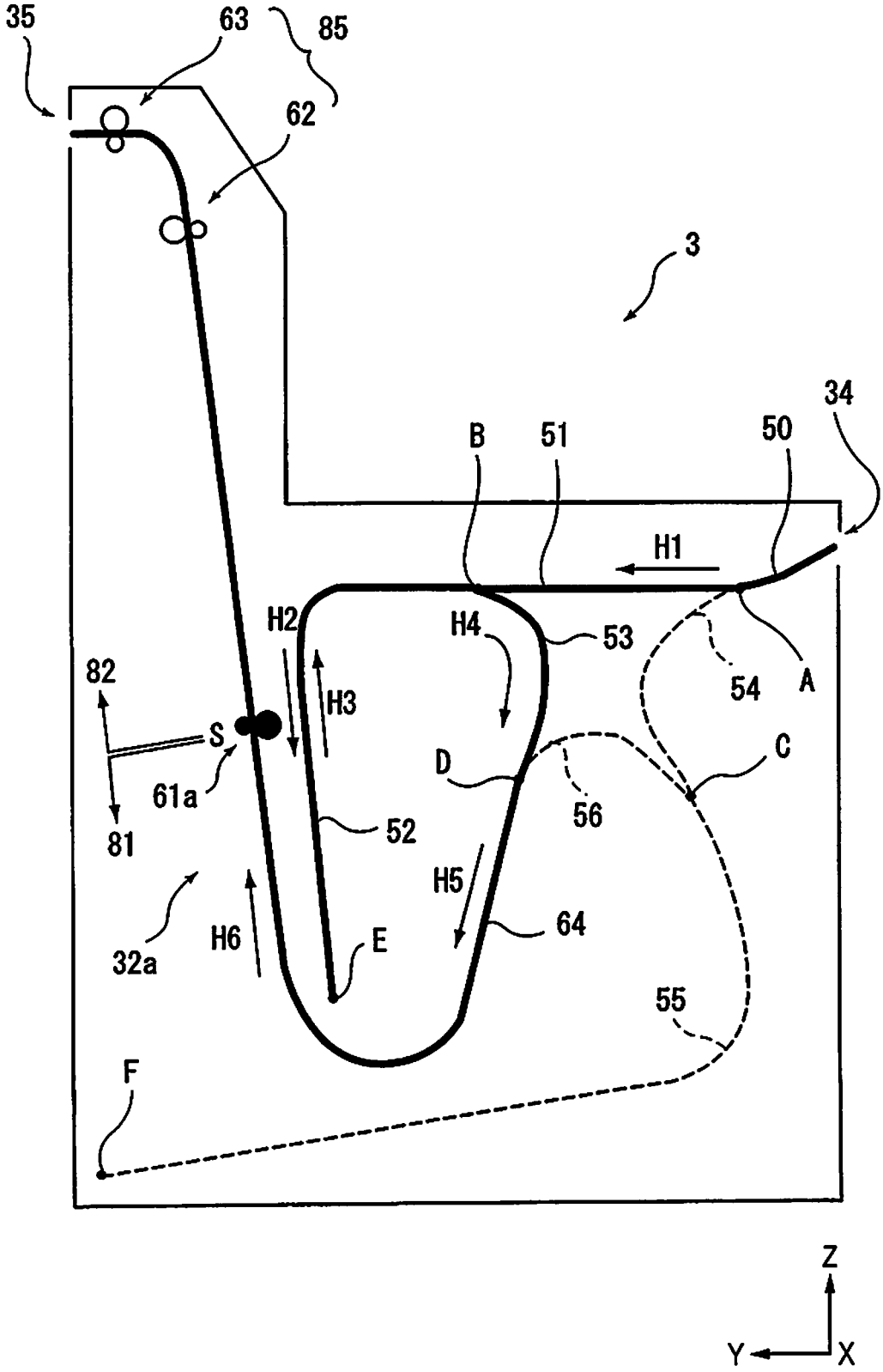
FIG. 5 is a schematic diagram illustrating a transport path passing through a first switchback path.
Figure 6:
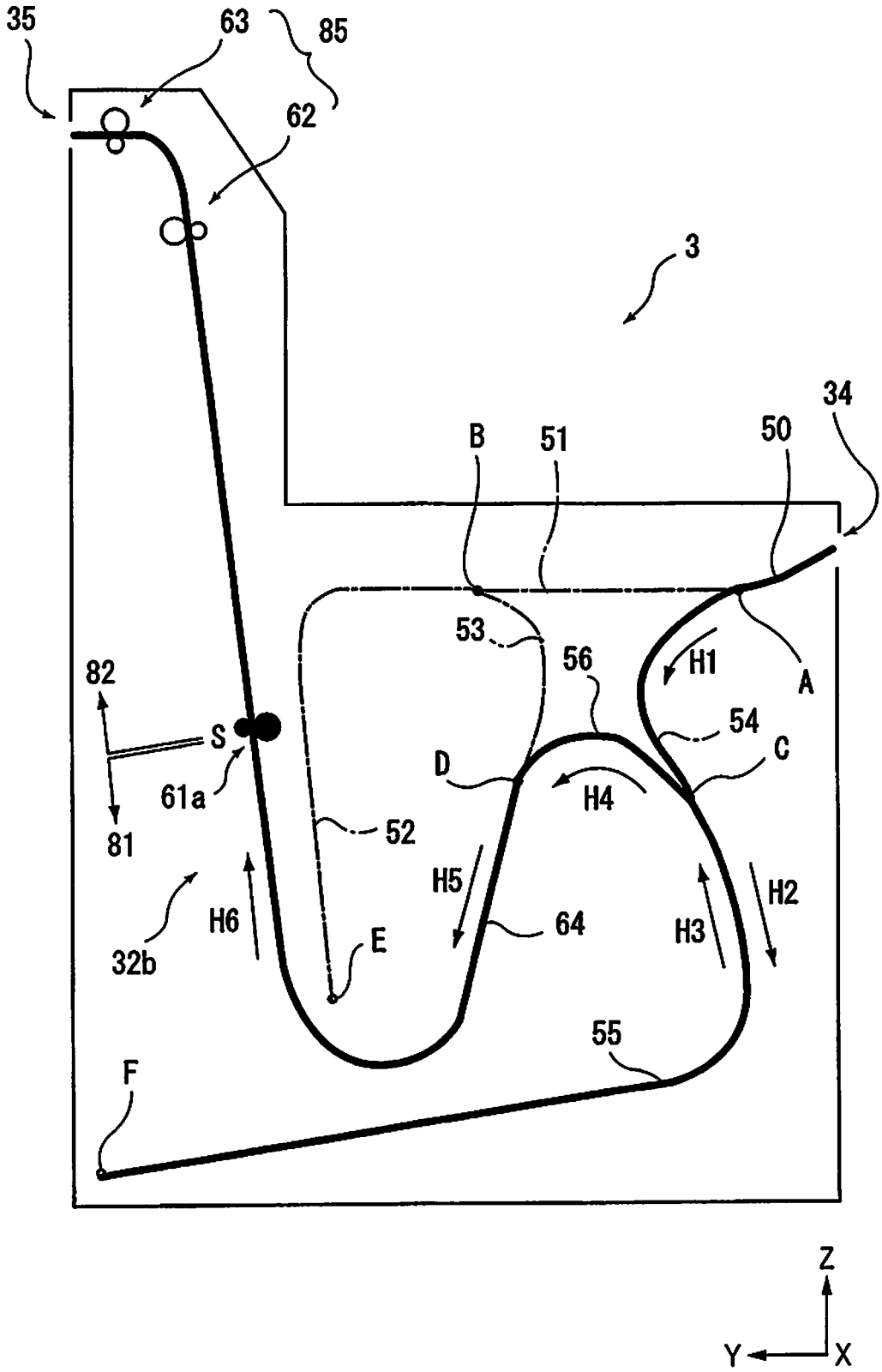
FIG. 6 is a schematic diagram illustrating a transport path passing through a second switchback path.
Figure 7:
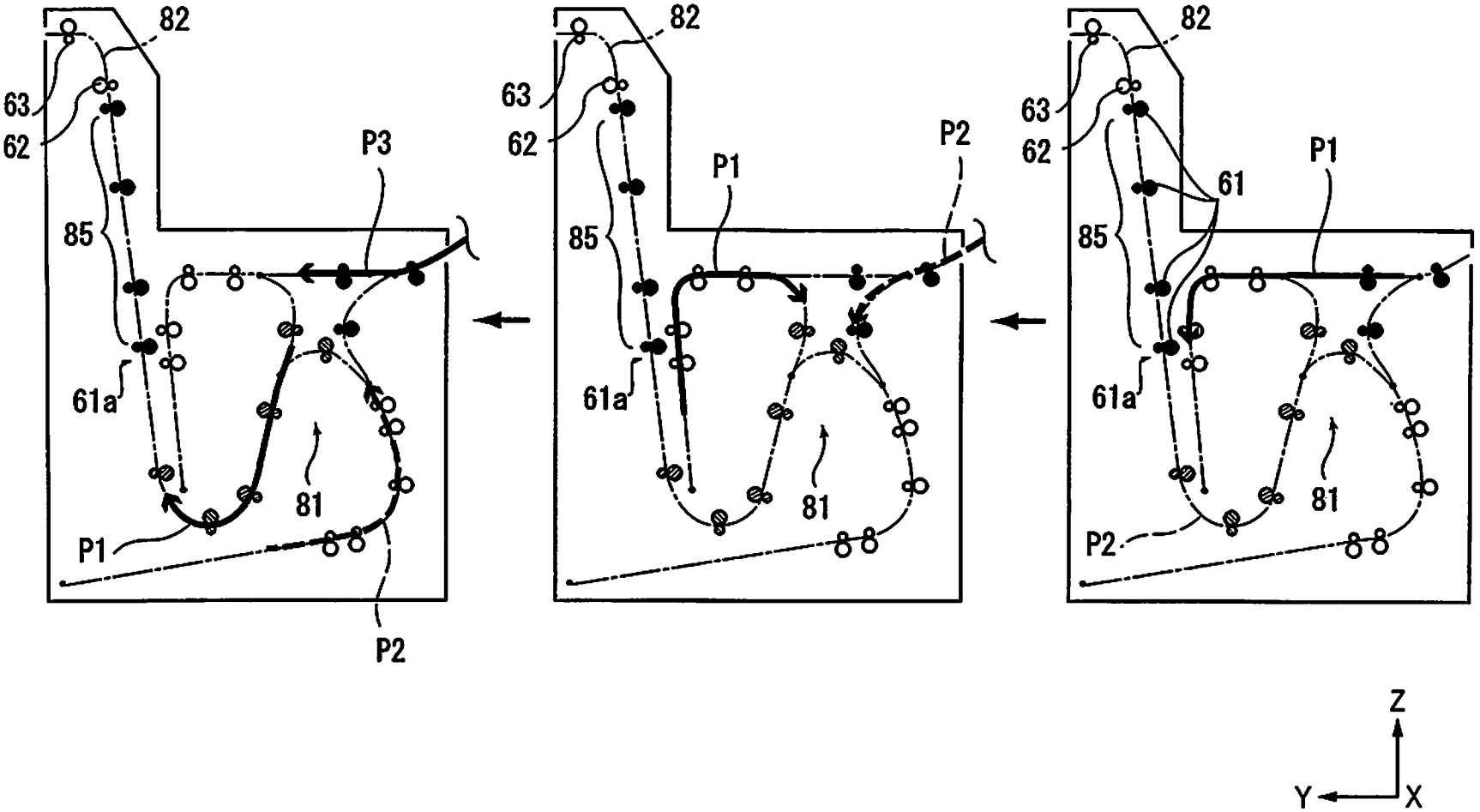
FIG. 7 is a diagram illustrating transport of a plurality of sheets of paper in a relay transport path.
Figure 8:
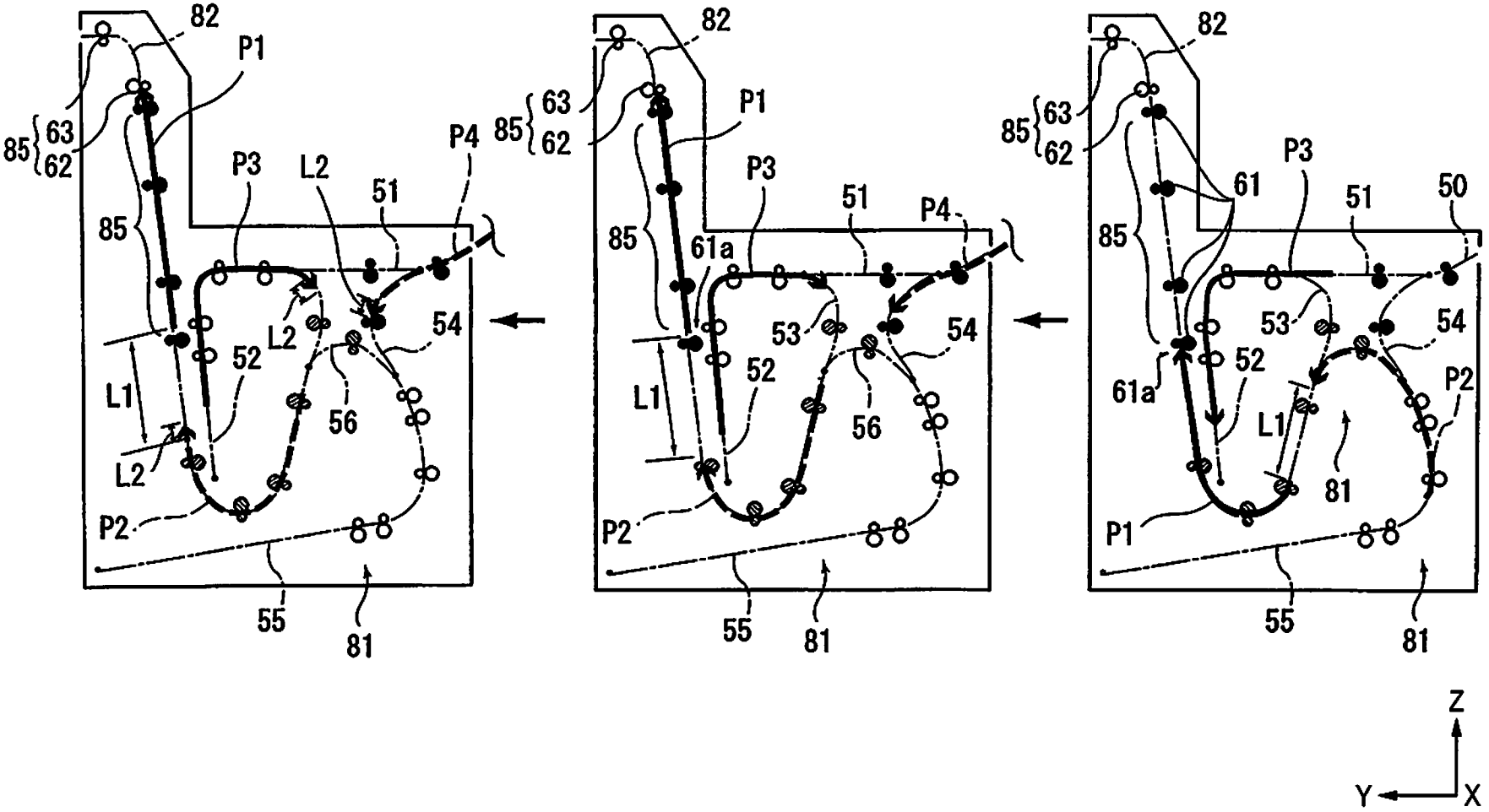
FIG. 8 is a diagram illustrating transport of a plurality of sheets of paper in a relay transport path.
Figure 9:
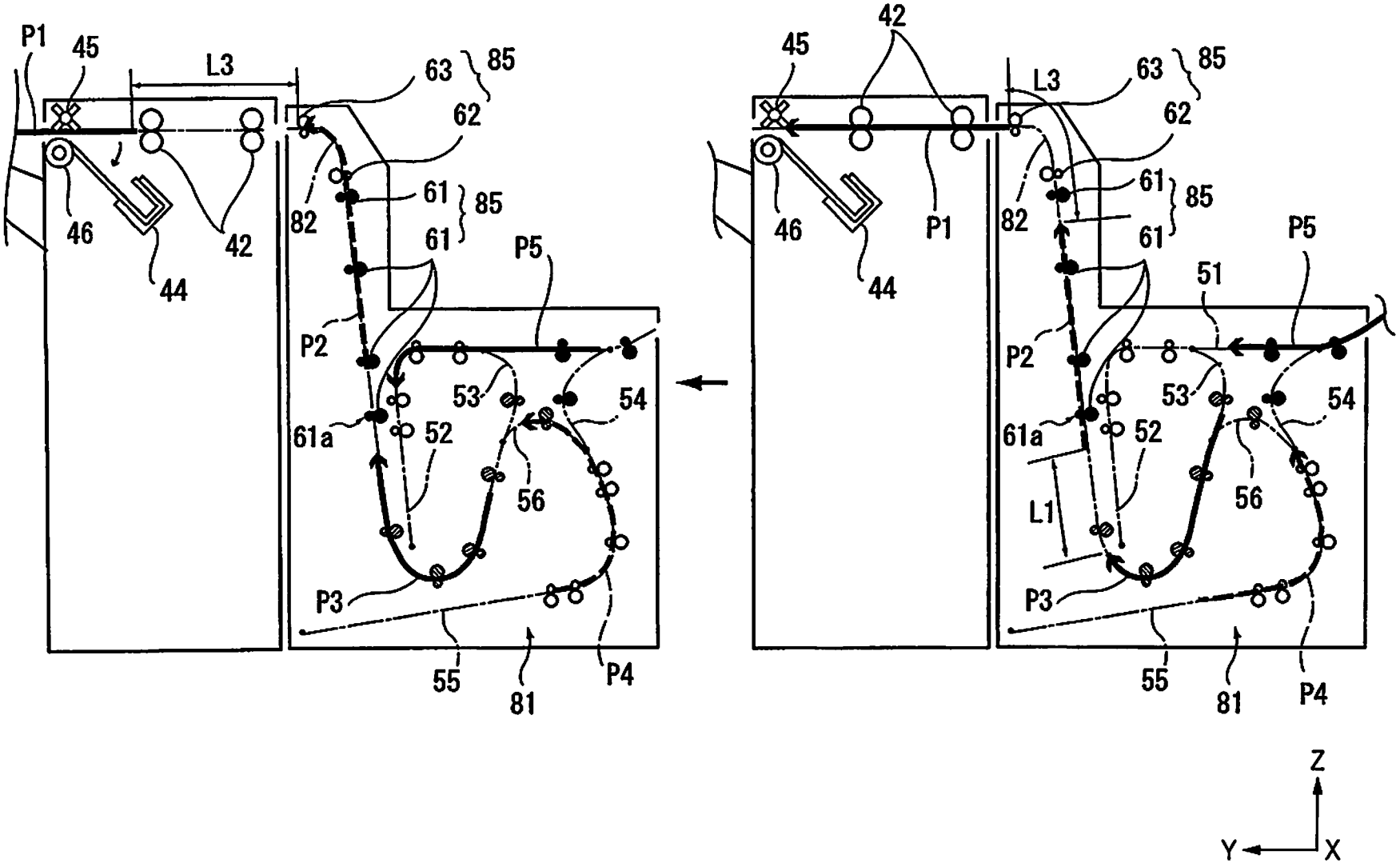
FIG. 9 is a diagram illustrating transport of a plurality of sheets of paper in a relay transport path.
Figure 10:
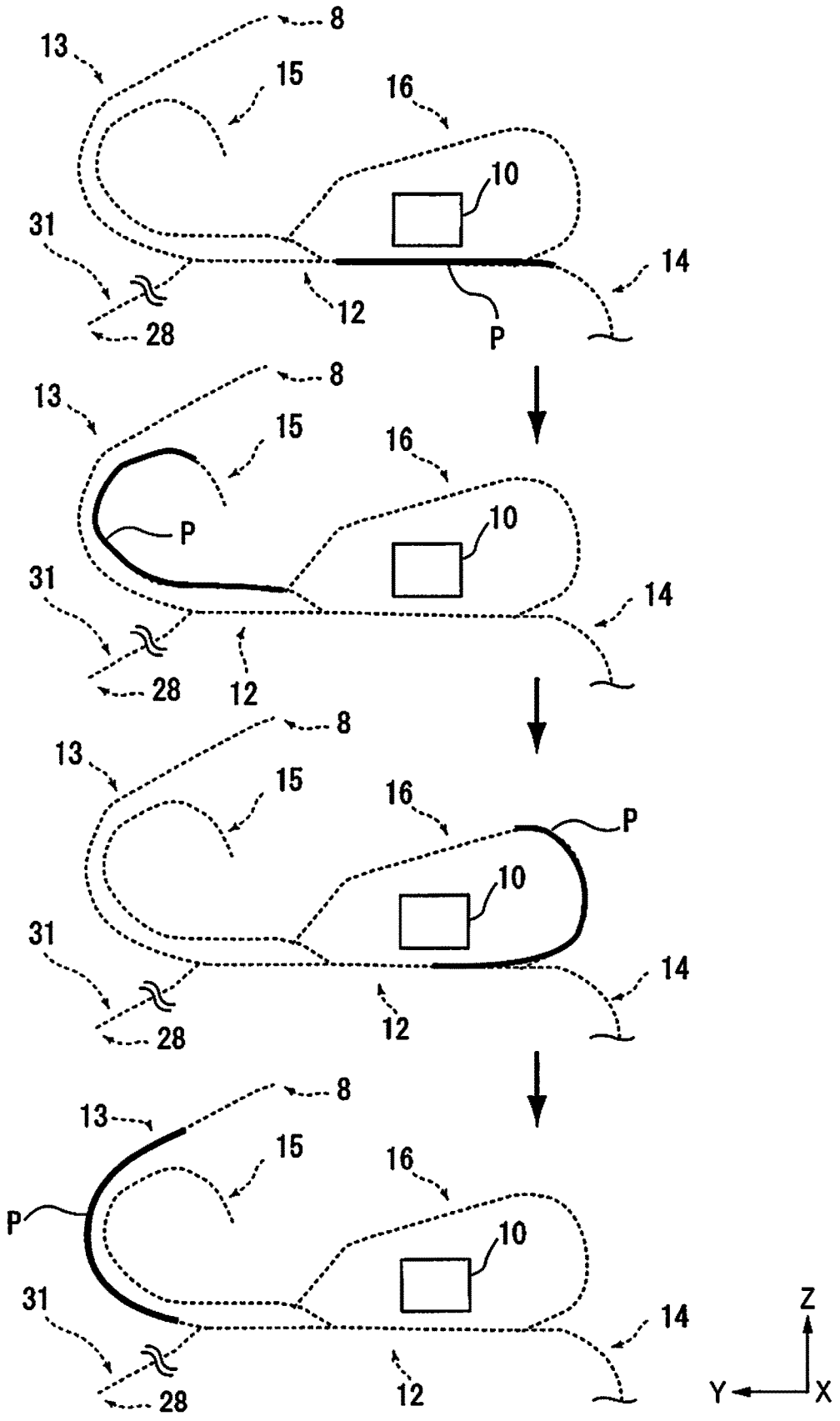
FIG. 10 is a diagram illustrating transport paths at the time of double-sided recording.

FIG. 1 is a schematic view of a recording system according to the invention. FIG. 2 is a side sectional view of a part of a recording mechanism unit and a relay mechanism unit. FIG. 3 is a schematic view illustrating transport paths of the recording mechanism unit. FIG. 4 is a schematic diagram illustrating transport paths of the relay mechanism unit. FIG. 5 is a schematic diagram illustrating a transport path passing through a first switchback path. FIG. 6 is a schematic diagram illustrating a transport path passing through a second switchback path. FIG. 7 is a diagram illustrating transport of a plurality of sheets of paper in a relay transport path. FIG. 8 is a diagram illustrating transport of a plurality of sheets of paper in a relay transport path. FIG. 9 is a diagram illustrating transport of a plurality of sheets of paper in a relay transport path. FIG. 10 is a diagram illustrating transport paths at the time of double-sided recording.

In addition, in an X-Y-Z coordinate system illustrated in each drawing, the X-axis direction is a width direction of a recording medium and indicates a depth direction of an apparatus, the Y-axis direction is a transport direction of the recording medium in a transport path in a recording apparatus and indicates a width direction of the apparatus, and the Z-axis direction indicates a height direction of the apparatus.

Outline of Recording System

A recording system 1 illustrated in FIG. 1 includes a recording mechanism unit 2 that performs recording on paper serving as a "medium", a relay mechanism unit 3, and a post-processing mechanism unit 4. As an example, the recording mechanism unit 2, the relay mechanism unit 3, and the post-processing mechanism unit 4 are sequentially provided in the recording system 1 from right to left in FIG. 1. In the present embodiment, the recording mechanism unit 2, the relay mechanism unit 3, and the post-processing mechanism unit 4 are connected to each other, and are configured such that a medium can be transported from the recording mechanism unit 2 to the post-processing mechanism unit 4.

In the recording system 1, a transport path for transporting paper between a line head 10 (recording unit) and a post-processing unit 44 is referred to as a relay transport path 30. The relay transport path 30 will be described below in detail.

Furthermore, in addition to a case where the recording mechanism unit 2, the relay mechanism unit 3, and the post-processing mechanism unit 4 are individually configured so as to be connected to each other, the recording system 1 may have a configuration in which the recording mechanism unit 2, the relay mechanism unit 3, and the post-processing mechanism unit 4 are integrally provided in, for example, one case.

The recording system 1 is configured such that a recording operation and the like can be input from an operation panel (not illustrated) provided in the recording mechanism unit 2, to the medium the recording mechanism unit 2, the relay mechanism unit 3, and the post-processing mechanism unit 4.

Hereinafter, the respective schematic configurations of the recording mechanism unit 2, the relay mechanism unit 3, and the post-processing mechanism unit 4 will be sequentially described.

Recording Mechanism Unit

The recording mechanism unit 2 illustrated in FIG. 1 is configured as a multifunctional printer including a printer unit 5 having the line head 10 (FIG. 3) serving as a "recording unit" for performing a record by ejecting ink which is an example of "liquid" on paper, and a scanner unit 6. In the present embodiment, the ink is a water-based ink such as an aqueous ink, and the printer unit 5 is a so-called ink jet printer.

The recording mechanism unit 2 is configured to be capable of double-sided recording in which recording is performed on a second side (also referred to as a rear side) by inverting paper after recording is performed on a first side (also referred to as a front side) of the paper.

A plurality of paper storage cassettes 7 are provided in a lower portion of the recording mechanism unit 2 (FIG. 1). Paper stored in the paper storage cassette 7 is sent toward the line head 10, and a recording operation is performed. A configuration is provided such that the paper on which recording is performed by the line head 10 is discharged to either a first discharge unit 8 provided in the recording mechanism unit 2 or a second discharge unit 40 provided in the post-processing mechanism unit 4. The second discharge unit 40 discharges a medium for which post-processing such as cutting or stapling is performed in the post-processing unit 44 of the post-processing mechanism unit 4.

In a case where the recorded paper is discharged from the second discharge unit 40, the recorded paper is sent from a delivery unit 28 to the relay mechanism unit 3 and is sent toward the post-processing mechanism unit 4 including the post-processing unit 44 via the relay mechanism unit 3.

Furthermore, a paper transport path in the printer unit 5 of the recording mechanism unit 2 will be described in detail below.

Relay Mechanism Unit

The relay mechanism unit 3 (FIG. 1) is disposed between the recording mechanism unit 2 and the post-processing mechanism unit 4 and is configured such that paper delivered from the delivery unit 28 is transported to the post-processing mechanism unit 4.

A paper transport path in the relay mechanism unit 3 is configured to include a first transport path 81 and a second transport path 82 connected to the first transport path 81. The first transport path 81 and the second transport path 82 take at least a part of a relay transport path 30 which will be described below.

In addition, the relay mechanism unit 3 dries paper by transport the paper over a predetermined period or more. Thereby, it is possible to earn transport time of paper.

The paper transported inside the relay mechanism unit 3 is sent from an exit unit 35 provided in the relay mechanism unit 3 to the post-processing mechanism unit 4 via a reception unit 41 of the post-processing mechanism unit 4.

The first transport path 81 and the second transport path 82 that configure the relay transport path 30 will be described below together with a paper transport path in the printer unit 5.

Post-Processing Mechanism Unit

In addition, the post-processing mechanism unit 4 (FIG. 1) is configured to include the post-processing unit 44 that performs post-processing for the paper on which recording is performed in the recording mechanism unit 2. The post-processing performed by the post-processing unit 44 includes cutting, paper folding, hole punching, stapling, sorting, and the like as an example.

A third transport path 86, which is a paper transport path in the post-processing mechanism unit 4, is connected to the second transport path 82 and takes a part of the relay transport path 30 which will be described below.

Hereinafter, the paper transport path in the recording mechanism unit 2, and paper transport paths in the relay mechanism unit 3 and the post-processing mechanism unit 4 will be sequentially described.

About Medium Transport Path of Recording Unit

Next, the paper transport path in the recording mechanism unit 2 will be described with reference to FIG. 3.

In FIG. 3, a dotted line indicated by a symbol T indicates a part of the paper transport path from the paper storage cassette 7. The paper transport path T is configured to include a feed path 14 for sending paper picked up from the paper storage cassette 7 and a straight path 12 that is connected to the feed path 14 and includes a recording region by the line head 10.

Furthermore, a discharge path 13 (denoted by an alternate long and two short dashes line in FIG. 3) for sending the paper to the first discharge unit 8 and a delivery path 31 (denoted by an alternate long and short dash line in FIG. 3) that is a path to the delivery unit 28 which delivers paper to the relay mechanism unit 3 are provided on a downstream side of the straight path 12.

A switch unit 26 such as a guide flap, which switches a transport destination of the recorded paper between the delivery unit 28 and the first discharge unit 8, is provided in a connection portion between the straight path 12, the discharge path 13, and the delivery path 31. An operation of the switch unit 26 is controlled by a control unit 27. Furthermore, the control unit 27 controls an operation relating to recording of the operation of the switch unit 26 or the like, in addition to the transport operation of paper in the recording system 1.

Hereinafter, transport of paper from the paper storage cassette 7 to the first discharge unit 8 will be described first, and subsequently, transport in a case where the recorded paper is sent to the second discharge unit 40 via the relay mechanism unit 3 (a case of passing through the relay transport path 30) will be described.

About Paper Transport Path to First Discharge Unit

As illustrated in FIG. 3, a feed roller 17 and a pair of separation roller 18 that separates a plurality of sheets of paper into a sheet of paper are sequentially provided in the feed path 14 in a medium transport direction.

The feed roller 17 is configured to be rotationally driven by a drive source (not illustrated). In addition, the pair of separation rollers 18 are also called a retard roller and are configured to includes a drive roller 18*a* that sends paper toward the straight path 12 which will be described below, and a driven roller 18*b* which separates paper by nipping between the drive roller 18*a* and the driven roller pair 18*b*.

A plurality of sheets of paper can be stored in the paper storage cassette 7, and the uppermost paper is picked up by the feed roller 17 and is transported on the downstream side in the transport direction. At this time, there is a case where subsequent sheets of paper are also transported together with the uppermost paper, but the uppermost sheet and the subsequent paper are separated by the pair of separation rollers 18, and only the uppermost paper is sent to the feed path 14.

A pair of resistance rollers 19 provided on an upstream side of belt transport means 20 which will be described below are provided on the downstream side of the pair of separation rollers 18 in the transport direction.

In the present embodiment, the feed path 14 and the straight path 12 are connected to each other at a position of the pair of resistance rollers 19.

The straight path 12 is configured as a path that extends a substantially linear shape, and belt transport means 20, a neutralizing unit 25, and the line head 10 are provided on a downstream side of the pair of resistance rollers 19.

In the present embodiment, the belt transport means 20 is disposed in a region facing a head surface of the line head 10, and supports a side opposite to a recording surface of paper.

When paper is transported to a position facing the line head 10 on the belt transport means 20, the line head 10 is configured to perform recording by ejecting ink serving as "liquid" on a recording surface of the paper. The line head 10 is a recording head provided in a shape in which a nozzle that ejects ink covers an entire width of the paper, and is configured as a recording head capable of performing recording on an entire width of a medium without movement in a medium width direction.

Furthermore, the recording mechanism unit 2 of the present example includes the line head 10, but may include a serial type recording head which is mounted on a carriage and performs recording by ejecting liquid onto a medium while reciprocating in a direction crossing a medium transport direction.

Paper transported through the straight path 12 is subsequently sent to the discharge path 13. The discharge path 13 is a transport path having a curvature connected to the straight path 12 on the downstream side of the line head 10 and is a path for sending paper to discharge from the first discharge unit 8 in a state where a recording surface of the paper recorded by the line head 10 faces downward.

The paper in the discharge path 13 is transported by a pair of transport rollers 21 and 22 and a group of pairs of transport rollers 23, is discharged from the first discharge unit 8, and is mounted on a medium mounting unit 9 in a state where the recording surface faces downward.

About Transport Path Up to Second Discharge Unit

The recorded paper is transported to the second discharge unit 40 through the relay transport path 30 (FIG. 1). As described above, the relay transport path 30 is a transport path for transporting paper between the line head 10 (recording unit) and the post-processing unit 44. In the present embodiment, the first transport path 81 and the second transport path 82 (see also FIGS. 2 and 4) which are transport paths in the relay mechanism unit 3, and the third transport path 86 which is a transport path in the post-processing mechanism unit 4 are collectively referred to as the relay transport path 30.

Furthermore, the relay transport path 30 may include a transport path from shortly after (downstream) of the line head 10 to immediately before (upstream) the first transport path 81.

More specifically, the relay transport path 30 (FIG. 1) is configured to include the first transport path 81 provided on an upstream side, the second transport path 82 which is connected to the first transport path 81 on a downstream side in a medium transport direction and includes a pair of correction rollers 62 (see also FIG. 4) that will be described below, and the third transport path 86 which is connected to the second transport path 82 on a downstream side in the medium transport direction.

Furthermore, a characteristic portion of the invention is a configuration relating to transport of a plurality of sheets of paper in the relay transport path 30. This point will be described in detail below after the respective paths of the first transport path 81, the second transport path 82, and the third transport path 86 that configure the relay transport path 30 are described.

About First Transport Path and Second Transport Path

As described above, the first transport path 81 and the second transport path 82 are transport paths in the relay mechanism unit 3.

The first transport path 81 is a path for delivering paper from the recording mechanism unit 2 and indicates a path on a more upstream side than a group 61 of pairs of fifth transport rollers 61 (FIG. 4) which will be described below in the present embodiment. In addition, the second transport path 82 is a path which is connected to the first transport path 81 on a downstream side and transports paper toward the post-processing unit 44 of the post-processing mechanism unit 4.

The paper on which recording is performed in the recording mechanism unit 2 is sent from the delivery unit 28 of the recording mechanism unit 2 to the relay mechanism unit 3 (see FIGS. 2 and 3). Specifically, the recorded paper is sent to the delivery path 31, passes through the delivery unit 28, and enters into the first transport path 81 from the entrance unit 34 of the relay mechanism unit 3.

Hereinafter, the first transport path 81 and the second transport path 82 will be described in more detail with reference to FIG. 4. Furthermore, in each pair of transport rollers illustrated in FIG. 4, a drive roller driven by a drive source such as a motor is illustrated as a large circle, and a driven roller that is driven to rotate is illustrated as a small circle. Driving of the drive rollers of each pair of transport rollers are controlled by the control unit 27 (FIGS. 1 and 3), and thereby, paper is transported.

The first transport path 81 (FIG. 4) includes a branch point A, a branch point B, and a branch point C where the transport paths branch, a confluence point D where the transport paths join, an end portion E where a transport path of paper ends, and an end portion F. In addition, a guide flap (not illustrated) for dividing the transport path of paper is provided in the branch point A, the branch point B, and the branch point C.

An introduction path 50, a first branch path 51 serving as "branch paths" for branching a path from the introduction path 50, and a second branch path 54 are provided on an upstream side of the first transport path 81. The first branch path 51 and the second branch path 54 branch such that paper introduced from the recording mechanism unit 2 is sent to either the first switchback path 52 or the second switchback path 55.

The first switchback path 52 and the second switchback path 55 are paths for performing a switchback operation of reversing a transport direction of the paper.

The first switchback path 52 is a branch destination of one of the "branch paths" and is connected to the first branch path 51. The second switchback path 55 is the other branch destination of the "branch path" and is connected to the second branch path 54.

A first inversion path 53 is a path for inverting the paper for which a switchback operation is performed in the first switchback path 52. A second inversion path 56 is a path for inverting the paper for which a switchback operation is performed in the second switchback path 55. A confluence path 64 is a path where the first inversion path 53 and the second inversion path 56 joins. The confluence path 64 is connected to the second transport path 82 at a position S illustrated in FIG. 4.

In the present embodiment, a path including the introduction path 50, the first branch path 51, the first switchback path 52, the first inversion path 53, the second branch path 54, the second switchback path 55, the second inversion path 56, and the confluence path 64 is the first transport path 81, and a path on a more downstream side than the confluence path 64 is the second transport path 82.

A group 57 of pairs of the first transport rollers is provided in the introduction path 50, the first branch path 51, and the second branch path 54. A group 58 of pairs of second transport rollers is provided in the first switchback path 52. A pair of third transport rollers 59 is provided in the second switchback path 55. A group 60 of pairs of fourth transport rollers is provided in the first inversion path 53, the second inversion path 56, and the confluence path 64. In the present embodiment, the group 57 of pairs of the first transport rollers, the group 58 of pairs of the second transport rollers, the group 59 of pairs of the third transport rollers 59, and the group 60 of pairs of the fourth transport rollers which are provided in the first transport path 81 are referred to as upstream side transport means 84 (FIG. 4).

The group 61 of pairs of the fifth transport rollers, the pair of correction rollers 62, and the pair of discharge rollers 63 are provided in the second transport path 82 as a plurality of transport rollers for transporting paper. The group 61 of pairs of the fifth transport rollers, the pair of correction rollers 62, and the pair of discharge rollers 63 which are provided in the second transport path 82 are referred to as downstream side transport means 85 (FIG. 4).

In addition, the pair of correction rollers 62 is an example of "correction transport means" to which a leading edge of paper is butted to perform a "skew correction operation" and then to transport the paper.

The pair of correction rollers 62 performs the "skew correction operation" for correcting skew of the paper with respect to the transport direction in the second transport path 82 (that is, the relay transport path 30). The "skew correction operation" is performed by the control unit 27 by decelerating transport speed of paper when a leading edge of the paper reaches the pair of correction rollers 62. In the present embodiment, by placing paper on the pair of correction rollers 62 in a stopped state, a position of the leading edge of the paper with respect to the transport direction is aligned, and the skew is corrected.

The paper of which skew is corrected by the "skew correction operation" is nipped by the pair of correction rollers 62 and is sent out toward the exit unit 35.

The pair of correction rollers 62 is located on the downstream side in the transport direction with respect to the group 61 of pairs of fifth transport rollers and is arranged such that the leading edge of the paper reaches the exit unit 35 during the transport made by the pair of correction rollers 62. That is, the pair of correction rollers 62 is disposed near the exit unit 35.

Furthermore, the group 58 of pairs of second transport rollers and the group 59 of pairs of third transport rollers are rotatable in a normal rotation direction or a reverse rotation direction, and can invert a transport direction of the paper in the first switchback path 52 and the second switchback path 55.

In addition, the group 61 of pairs of fifth transport rollers, the pair of correction rollers 62, and the pair of discharge rollers 63 which are provided in the second transport path 82 illustrated in FIG. 4 are rotationally driven by a common drive source 83 (FIG. 2). The group 61 of pairs of fifth transport rollers is configured to be capable of switching on or off power transmission of the drive source 83, and is configured to switch off the power transmission of the drive source 83 at the time of performing the "skew correction operation". As the result, at the time of the "skew correction operation", the group 61 of pairs of fifth transport rollers is decelerated. ON or OFF of the power transmission of the drive source 83 can be switched by using, for example, an electromagnetic clutch (not illustrated).

The pair of correction rollers 62 and the pair of discharge rollers 63 are configured to be capable to switching on or off the power transmission of the drive source 83 by the electromagnetic clutch (not illustrated) in the same manner as in the group 61 of pairs of fifth transport rollers. In addition, the pair of correction rollers 62 includes an electromagnetic clutch (not illustrated) for applying a brake when rotation thereof is stopped in accordance with performance of the "skew correction operation".

Subsequently, a flow of paper transport in the first transport path 81 and the second transport path 82 will be described with reference to FIGS. 5 and 6. Furthermore, FIGS. 5 and 6 correspond to FIG. 4, and illustrating configuration elements unnecessary for description a transport system such as the group 57 of pairs of first transport rollers to the group 61 of pairs of fifth transport rollers, the pair of correction rollers 62, and the discharge roller pair 63 is omitted. Furthermore, in FIGS. 5 and 6, the transport path used for transporting paper is denoted by a solid line, and the transport path not used for transporting the paper is denoted by a dashed line. On addition, in FIGS. 5 and 6, the arrows in the figures indicate a transport direction of paper, and reference numerals H1 to H6 are attached to the transport paths, respectively.

It is possible to transport paper in two ways of a route 32*a* (a path indicated by a solid line in FIG. 5) illustrated in FIG. 5 and a route 32*b* (a path indicated by a solid line in FIG. 6) illustrated in FIG. 6 as a route (way) for entering into the second transport path 82 via the first transport path 81.

As indicated by the solid line in FIG. 5, the route 32*a* on which paper is transported is configured by the introduction path 50, the first branch path 51, the first switchback path 52, the first inversion path 53, the confluence path 64, and the second transport path 82.

When paper proceeds along the route 32*a* (FIG. 5), the paper sent from the entrance unit 34 passes through the introduction path 50, proceeds along the first branch path 51 in a transport direction H1, and enters into the first switchback path 52. After the paper transported from the first switchback path 52 proceeds in a transport direction H2, a travel direction of the paper is inverted (switched back), and the paper proceeds in a transport direction H3 opposite to the transport direction H2 and enters into the first inversion path 53. Subsequently, the paper proceeds along the first inversion path 53 in a transport direction H4, enters into the confluence path 64, further enters into the second transport path 82 from the confluence path 64, and exits from exit unit 35 toward the reception unit 41 (FIG. 1) of the post-processing mechanism unit 4 (see the transport direction H5 and the transport direction H6).

Meanwhile, the route 32*b* indicated by the solid line in FIG. 6 is configured by the introduction path 50, the second branch path 54, the second switchback path 55, the second inversion path 56, the confluence path 64, and the second transport path 82.

When the paper proceeds along the route 32*b*, the paper transported from the entrance unit 34 passes through the introduction path 50, proceeds along the second branch path 54 in the transport direction H1, and enters into the second switchback path 55. After the paper transported from the second switchback path 55 proceeds in the transport direction H2, a direction in which the paper proceeds is inverted (switched back), and the paper proceeds in the transport direction H3 opposite to the transport direction H2 and enters into the second inversion path 56. Subsequently, the paper proceeds along the second inversion path 56 in the transport direction H4, enters into the confluence path 64, further enters into the second transport path 82 from the confluence path 64, and exits from the exit unit 35 toward the reception unit 41 (FIG. 1) of the post-processing mechanism unit 4 (see the transport direction H5 and the transport direction H6).

In a case where continuous recording is performed on a plurality of sheets of paper, paper entering from the entrance unit 34, for example, a preceding medium on which the recording is previously performed is guided to the route 32*a* by a guide flap (not illustrated) provided in the branch point A. Subsequently, a succeeding medium entering from the entrance unit 34 is guided to the route 32*b* by the guide flap (not illustrated) provided in the branch point A.

Then, transport of the paper made by the route 32*a* and transport of the paper made by the route 32*b* are alternately repeated.

In the above-described discharge path 13 (a path for discharging the recorded paper from the first discharge unit 8 of the recording mechanism unit 2), the control unit 27 does not perform a switchback operation of reversing the transport direction of the paper in the discharge path 13, and discharges the paper in the transport direction as it is.

Meanwhile, in a case where paper is discharged from the second discharge unit 40 through the relay mechanism unit 3, a switchback operation is performed in the first switchback path 52 or the second switchback path 55, and thereby, transport time is lengthened. Accordingly, it is possible to adopt a configuration in which the drying time of paper is lengthened, and to appropriately perform post-processing in the post-processing mechanism unit 4.

In addition, the first transport path 81 includes two switchback paths (the first switchback path 52 and the second switchback path 55), and thereby, it is possible to adopt a configuration in which paper passes through one of the two transport paths (the routes 32*a* and 32*b*) before reaching the second transport path 82, and to increase transport ability of paper, compared with a case where one transport path is provided.

In addition, as described above, in a case where continuous recording is performed on a plurality of sheets of paper, it is possible to use different transport paths for a preceding medium and a succeeding medium. Thus, it is possible to shorten an interval between the preceding medium and the succeeding medium, and to secure drying time while suppressing a decrease in throughput.

In the recording mechanism unit 2, if ink (water-based ink in the present embodiment) is ejected from the line head 10 onto paper, moisture of the ink penetrates into the paper and is absorbed. The relay mechanism unit 3 evaporates the moisture absorbed by the paper to dry while the paper is transported. Since the first transport path 81 includes the first switchback path 52 and the second switchback path 55, a transport distance is long, and in a case where the transport distance is short, for example, it is possible to more properly dry the ink attached to the paper as compared with a case where the paper is transported through the discharge path 13 of the recording mechanism unit 2.

In the first switchback path 52 or the second switchback path 55, a position of a surface (for example, a first surface) of paper with respect to the transport direction is inverted before and after a direction in which the paper proceeds is switched back.

Accordingly, while paper entering from the entrance unit 34 is transported through the first transport path 81, front and rear (positions of the first surface and the second surface) of the paper with respect to the transport direction are inverted. Then, in a state where the front and back with respect to the transport direction are inverted, the paper exits from the exit unit 35 toward the post-processing mechanism unit 4 (FIG. 1).

About Third Transport Path

Paper exiting from the exit unit 35 enters into the third transport path 86 from the reception unit 41 of the post-processing mechanism unit 4 illustrated in FIG. 1. The third transport path 86 is a path for transporting the paper output from the second transport path 82.

The post-processing mechanism unit 4 includes a group 42 of pairs of sixth transport rollers which are transport means in the third transport path 86, and the post-processing unit 44 that is provided on a downstream side of the group 42 of pairs of sixth transport rollers and temporarily stacks paper prior to post-processing, and the second discharge unit 40 that discharges the post-processed paper.

Paper entered into the third transport path 86 is sent by the group 42 of pairs of sixth transport rollers, and a leading edge side of the paper arrives at the second discharge unit 40 once. An impeller unit 45 is provided near an upstream side of the second discharge unit 40, a trailing edge side of the paper is placed on the impeller unit 45 which rotates, and thereby, the paper is obliquely dropped downward on a −Y-axis direction side and is temporarily stacked in the post-processing unit 44.

If plural sheets (which may be one sheet) of paper set for post-processing are stacked in the post-processing unit 44, post-processing (cutting, stapling, and the like) is performed. After the post-processing is performed, the paper or a bundle of papers are discharged by the discharge roller 46 in a +Y-axis direction and are mounted on a discharge stacker 47.

In the present embodiment, driving of each roller, the impeller unit 45, and the like in the third transport path 86 are also controlled by the control unit 27 (FIGS. 1 and 3).

The above is a series of flow of transport of paper in the recording system 1.

About Transport of a Plurality of Sheets of Paper in Relay Transport Path

In a case where continuous recording is performed in the recording mechanism unit 2, the recorded paper is continuously sent to the relay transport path 30, and a preceding medium to be transported earlier and a succeeding medium to be transported subsequently to the preceding medium are transported in the relay transport path 30 at an interval therebetween.

Transport of a plurality of sheets of paper (symbols P1, P2, P3, . . . ) will be described with reference to FIGS. 7 and 8.

A right diagram of FIG. 7 illustrates a state where the first paper P1 is transported toward the first switchback path 52. In FIGS. 7 and 8, arrows are marked on leading edge sides of the plurality of sheets of paper (P1, P2, P3, . . . ) in the transport direction.

As illustrated in a middle diagram of FIG. 7, while a switchback operation of the first paper P1 (the preceding medium) in the first switchback path 52 is performed, the paper P2 serving as a succeeding medium is transported toward the second switchback path 55.

Furthermore, as illustrated in a left diagram of FIG. 7, the paper P1 is transported through the confluence path 64. The paper P3 is transported toward the first switchback path 52 while a switchback operation of the paper P2 is performed in the second switchback path 55.

Subsequently, a right diagram of FIG. 8 illustrates a state where the leading edge of the paper P1 serving as a preceding medium is transported to a position of a pair of upstream side transport rollers 61*a* located at the most upstream side among the group 61 of pairs of fifth transport rollers. The pair of upstream side transport rollers 61*a* is a plurality of pairs of transport rollers provided in the second transport path 82, that is, a pair of transport rollers located on the most upstream side of the downstream side transport means 85. At this time, an interval between a trailing edge of the paper P1 and a leading edge of the paper P2 is referred to as an interval L1.

However, in order for the relay transport path 30 to perform, for example, a switchback operation using the first switchback path 52 and the second switchback path 55, and a "skew correction operation" for butting paper into the pair of correction rollers 62, an interval between a preceding medium and a succeeding medium changes.

Particularly, if a leading edge of the paper P1 butts into the pair of correction rollers 62 and the "skew correction operation" is performed (middle diagram in FIG. 8), the preceding medium temporarily stops or speed thereof is decelerated and the succeeding medium is transported even in the meantime, and thereby, the interval between the preceding medium and the succeeding medium is shortened. Specifically, if a distance that each of the paper P2 to the paper P4 proceeds is referred to as L2, while the "skew correction operation" for the paper P1 is being performed, an interval between a trailing edge of the paper P1 and a leading edge of the succeeding paper P2 is shortened by the distance L2 (middle diagram in FIG. 8).

Thus, it is necessary for the interval L1 to be an interval at which the preceding medium (for example, paper P1) and the succeeding medium (for example, paper P2) do not collide with each other when at least the "skew correction operation" is performed.

Here, in a case where a plurality of sheets of paper are stacked in an overlapped manner in the post-processing unit 44 of the post-processing mechanism unit 4, leading edge sides of the paper reach the second discharge unit 40 once, and thereafter, the paper comes into contact with the impeller unit 45 and is dropped so as to slightly turn in a direction (−Y-axis direction) opposite to a medium transport direction by its own weight and is stacked as described above. Post-processing such as stapling is performed for the plurality of sheets of paper stacked in the post-processing unit 44. In a case where the stacking operation and the post-processing operation are performed, a relatively wide interval (for example, L3) is required between a preceding medium and a succeeding medium, as compared with a case where a plurality of sheets of paper are simply stacked on a tray in an overlapped manner.

For example, if the paper for which the "skew correction operation" is performed is stacked on the discharge stacker 47 as it is, a maximum value of the interval between the preceding medium and the succeeding medium in the relay transport path 30 may be set to the interval L1 in consideration of a possibility of collision at the time of performing the "skew correction operation".

However, in the present embodiment, the stacking operation and the post-processing operation are performed in the post-processing unit 44, and thereby, a wider interval L3 is required in a transport region before the preceding medium enters into the post-processing unit 44. If paper is transported by setting an interval between the preceding medium and the succeeding medium through the entire transport region of the relay transport path 30 as L3 (including an interval close to L3), avoidance of collision at the time of performing the "skew correction operation" and appropriate stacking operation and post-processing operation in the post-processing unit 44 can also be performed. However, processing speed (throughput) per unit time in the recording system decreases, as compared with, for example, a case where the post-processing is not performed.

Therefore, in the present embodiment, the control unit 27 is configured such that the interval between the preceding medium and the succeeding medium is widest in the transport region on a downstream side of the relay transport path 30 in the medium transport direction before the preceding medium enters into the post-processing unit 44.

That is, when the paper P1 serving as the preceding medium is transported to the front of the post-processing unit 44 as illustrated in the right diagram of FIG. 9, the interval between the preceding medium and the succeeding medium is widened, and the paper takes an interval (for example, L3) necessary for a case where post-processing is performed after the paper enters into the post-processing unit 44, and the paper is transported by shortening the interval between the preceding medium and the succeeding medium to the interval (for example, L1) narrower than L3, on the upstream side of the relay transport path 30 (for example, the first transport path 81 and the second transport path 82). By doing so, it possible to achieve both securing of ab interval necessary when the paper enters into the post-processing unit 44 and suppression of reduction in throughput of the recording system 1.

The interval between the preceding medium and the succeeding medium can be widened by increasing transport speed of the preceding medium more than the succeeding medium. The transport speed (average transport speed) of the medium in the relay transport path 30 will be described in detail below.

The present embodiment has a configuration in which, when a trailing edge of the preceding medium (paper P1) is located at a position of the pair of discharge rollers 63 serving as "a pair of downstream side transport rollers" located on the most downstream side among the plurality of pairs of transport roller (the group 61 of pairs of fifth transport rollers, the pair of correction rollers 62, and the pair of discharge rollers 63) provided in the second transport path 82, an interval between the preceding medium (paper P1) and the succeeding medium (paper P2) becomes L3 (right diagram in FIG. 9), and when a leading edge of the preceding medium (paper P1) is located at a position of the pair of upstream side transport rollers 61*a* located on the most upstream side among the plurality of pairs of transport rollers (the group 61 of pairs of fifth transport rollers, the pair of correction rollers 62, and the pair of discharge rollers 63), the interval L3 becomes wider than the interval L1 (right diagram in FIG. 8) between the preceding medium (paper P1) and the succeeding medium (paper P2).

By providing a configuration in which the interval L3 between the preceding medium and the succeeding medium when the preceding medium exits from the second transport path 82 is larger than the interval L1 between the preceding medium and the succeeding medium immediately before the preceding medium enters into the second transport path 82, it is possible to realize a configuration in which an interval between the preceding medium and the succeeding medium is maximized in a transport region on a downstream side of the relay transport path 30, that is, before the preceding medium enters into the post-processing unit 44.

As illustrated in the right diagram of FIG. 9, when a trailing edge of the preceding medium (paper P1) is transported to a position of the pair of discharge rollers 63, an interval between the preceding medium and the succeeding medium (paper P2) becomes L3 (distance required for post-processing), and as illustrated in the left diagram of FIG. 9, the preceding medium (paper P1) is sent to the post-processing unit 44 while maintaining the interval between the preceding medium and the succeeding medium (paper P2) maintains as L3 or more. In a state of the left diagram of FIG. 9, the interval between the preceding medium and the succeeding medium (paper P2) may be larger than L3.

It is preferable that the interval between the preceding medium and the succeeding medium be configured to be widest on the downstream side of the pair of correction rollers 62 in the medium transport direction.

That is, it is preferable that the "transport region before the preceding medium enters into the post-processing unit 44" in the relay transport path 30 be set as a region on a downstream side lower than the pair of correction rollers 62 in the relay transport path 30.

A configuration is provided in which, if the "skew correction operation" is performed for the preceding medium (paper P1) in the pair of correction rollers 62 to which the leading edge of the medium is butted as illustrated in the left diagram of FIG. 8, the interval between the preceding medium (paper P1) and the succeeding medium (paper P2) is shortened, but the interval between the preceding medium and the succeeding medium is widened on the downstream side of the pair of correction rollers 62 in the medium transport direction, and thereby, it is possible to avoid a possibility that the preceding medium collides with the succeeding medium.

Therefore, it is possible to secure the appropriate interval L3 between the preceding medium and the succeeding medium on the upstream side of the post-processing unit 44, and to send the paper whose posture is corrected by the pair of correction rollers 62 to the post-processing unit 44.

The "transport region before the preceding medium enters into the post-processing unit 44" in the relay transport path 30 can be changed by a configuration of an apparatus such as arrangement of pairs of various transport rollers in the relay transport path 30 and a size of the paper used for the recording system 1.

For example, in the recording system 1 according to the present embodiment, the interval between the preceding medium (paper P1) and the succeeding medium (paper P2) satisfies L3 or more at least in the transport region on the downstream side of the pair of discharge rollers 63 (left diagram of FIG. 9).

In addition, the present embodiment is configured such that, when the trailing edge of the preceding medium is transported onto the upstream side higher than the pair of discharge rollers 63, that is, to a position of the pair of discharge rollers 63 as illustrated in the right diagram of FIG. 9, the interval between the preceding medium and the succeeding medium is L3 or more, and the interval is maintained as L3 or more in a subsequent (downstream side) transport path.

About Average Transport Speed in Relay Transport Path

As described above, the interval between the preceding medium and the succeeding medium changes in the relay transport path 30 (the first transport path 81, the second transport path 82, and the third transport path 86). In other words, a medium transport speed in the relay transport path 30 changes.

The medium transport speed in the relay transport path 30 means an "average medium transport speed" in the relay transport path 30 (each transport path of the first transport path 81, the second transport path 82, and the third transport path 86).

In the present embodiment, a range of the first transport path 81 at the time of defining an average medium transport speed is a path from an end portion E or an end portion F which will be described below to a position S of FIG. 4. In addition, in the same manner, a range of the second transport path 82 at the time of defining the average medium transport speed is defined as a path from the position S of FIG. 4 to the pair of discharge rollers 63. A range of the third transport path 86 at the time of defining the average medium transport speed is defined as a path from the pair of transport rollers 42*a* on the upstream side to the discharge roller 46 among the group 42 of pairs of sixth transport rollers.

Since the switchback operation is performed in the first transport path 81 and the skew correction operation is performed in the second transport path 82, there is a case where the average medium transport speed in the first transport path 81 or the second transport path 82 does not necessarily match the transport speed of the upstream side transport means 84 or the downstream side transport means 85 at certain timing. The "average medium transport speed" means an average medium transport speed in the specific transport path range excluding a temporary fluctuation of the transport speed.

Here, definitions of the respective average medium transport speeds of the respective transport paths 81, 82, and 86 will be described in more detail.

First, the average medium transport speed in the first transport path 81 means an average value of the medium transport speed in a case where the timing at which switchback of a medium starts in the first switchback path 52 or the second switchback path 55 is set as a starting point and the timing at which a leading edge (an end portion on a transport direction side) of the medium after the switchback reaches the position S is set as an ending point, in a path from the end portion E or the end portion F to the position S in FIG. 4.

Next, the average medium transport speed in the second transport path 82 means an average value of the medium transport speed in a case where the timing at which a leading edge of a medium after the switchback reaches the position S is set as a starting point and the timing at which the leading edge of the medium after the switchback reaches the pair of discharge rollers 63 is set as an ending point, in a path from the position S in FIG. 4 to the pair of discharge rollers 63.

Next, the average medium transport speed in the third transport path 86 means an average value of the medium transport speed in a case where the timing at which the leading edge of the medium after the switchback reaches the pair of transport rollers 42*a* is set as a starting point and the timing at which the leading edge of the medium after the switchback reaches the discharge roller 46 is set as an ending point, in a path from the pair of transport rollers 42*a* on the upstream side to the discharge roller 46.

In the present embodiment, the average medium transport speed in the second transport path 82 of the relay transport path 30 is faster than the average medium transport speed in the first transport path 81. In addition, the average medium transport speed in the third transport path 86 is faster than the average medium transport speed in the second transport path 82.

The "skew correction operation" performed by the pair of correction rollers 62 is performed in the second transport path 82. If the "skew correction operation" is performed for the preceding medium, the interval between the preceding medium and the succeeding medium is shortened, and there is a possibility that the succeeding medium may collide with the preceding medium.

If the average medium transport speed in the second transport path 82 is faster than the average medium transport speed in the first transport path 81, although the interval between the preceding medium and the succeeding medium is shortened at the time of performing the "skew correction operation" for the preceding medium, the average transport speed of the preceding medium transported after the "skew correcting operation" is completed is faster than the average medium transport speed of the succeeding medium, and thereby, the shortened interval can be expanded. Accordingly, it is possible to suppress a possibility of collision of a medium due to performance of the skew correction operation.

The third transport path 86 is located on a downstream side in the relay transport path 30 and is a transport path that becomes "a transport region before the preceding medium enters into the post-processing unit 44". If the average medium transport speed in the third transport path 86 is faster than the average medium transport speed in the second transport path 82, the preceding medium previously entered into the third transport path 86 is sent at a high transport speed, and thereby, it is possible to realize a configuration in which the interval between the preceding medium and the succeeding medium is maximized in the transport region before the preceding medium enters into the post-processing unit 44 in the relay transport path 30.

The average medium transport speed in the first transport path 81, the second transport path 82, and the third transport path 86 is determined by the transport speed made by the transport means provided in each path.

The upstream side transport means 84 (the group 57 of pairs of first transport rollers, the group 58 of pairs of second transport rollers, the group 59 of pairs of third transport rollers, and the group 60 of pairs of fourth transport rollers illustrated in FIG. 4) provided in the first transport path 81 is configured to rotate at a constant speed.

In addition, the downstream side transport means 85 (the group 61 of pairs of fifth transport rollers, the pair of correction rollers 62, and the pair of discharge rollers 63 illustrated in FIG. 4) provided in the second transport path 82 is configured to rotate at a constant speed.

In addition, the group 42 of pairs of sixth transport rollers serving as transport means provided in the third transport path 86 is configured such that the pair of transport rollers 42*a* and the pair of transport rollers 42*b* each rotate at a constant speed.

In the present specification, the "constant speed" means that speed may be a substantially constant speed, and means that it is not necessary to be a completely constant speed in a strict sense. For example, it is assumed that the "constant speed" includes a case of being regarded as a constant speed in consideration of a transport error or the like caused by a roller diameter of each transport roller, eccentricity of a rotation axis, or the like, in addition to a case where speeds are exactly the same as each other.

In order to make an average medium transport speed of paper in the relay transport path 30 be the first transport path 81<the second transport path 82<the third transport path 86, transport speed (rotation speed of a drive roller of a pair of transport rollers) made by transport means provided in the relay transport path 30 is set so as to be the upstream side transport means 84<the downstream side transport means 85<the group 42 of pairs of sixth transport rollers.

An electromagnetic clutch (not illustrated) capable of switching on or off power transmission of the drive source is provided in the group 60 of pairs of fourth transport rollers configuring the upstream side transport means 84. When the paper to be transported is transported across the first transport path 81 and the second transport path 82, that is, in a case where a leading edge side of one sheet of paper is transported by the group 61 of pairs of fifth transport rollers serving as the downstream side transport means 85 and a trailing edge side thereof is transported by the group 60 of pairs of fourth transport rollers (transport speed thereof is relatively slower than the transport speed of the group 61 of pairs of fifth transport rollers) serving as the upstream side transport means 84, electromagnetic clutches of the group 60 of pairs of fourth transport rollers are turned off, and the group 60 of pairs of fourth transport rollers is configured to rotate together with the group 61 of pairs of fifth transport rollers which are relatively fast.

In addition, as described above, electromagnetic clutches (not illustrated) capable of switching on or off the power transmission of the drive source are also provided in the pair of discharge rollers 63, the pair of correction rollers 62, and the group 61 of pairs of fifth transport rollers that configure the downstream side transport means 85.

When the paper to be transported is transported across the second transport path 82 and the third transport path 86, that is, in a case where a leading edge side of one sheet of paper is transported by the group 42 of pairs of sixth transport rollers and a trailing edge side thereof is transported by the downstream side transport means 85, the electromagnetic clutches of the pair of discharge rollers 63, the pair of correction rollers 62, and the group 42 of pairs of sixth transport rollers are turned off, and the pairs of rollers are configured to rotate together with the group 42 of pairs of sixth transport rollers which are relatively fast.

In the present embodiment, the above-described electromagnetic clutches are all controlled by the control unit 27 (FIG. 1).

About Other Configurations in Recording Mechanism Unit Transport Path During Double-Sided Recording As described above, the recording mechanism unit 2 is configured to be able to perform double-sided recording, and includes a double-sided recording switchback path 15 which branches from the straight path 12, is on a downstream of the line head 10, and is on an upstream side (an upstream side of the pair of transport rollers 21 in FIG. 3 in the present embodiment) higher than the upstream side of the discharge path 13, and an inversion path 16 which is connected to the double-sided recording switchback path 15 and inverts front and rear (a first surface and a second surface) of paper to return to the straight path 12. Guide flaps 36 and 37 (FIG. 3) are respectively provided in a connection portion between the straight path 12 and the double-sided recording switchback path 15 and a connection portion between the double-sided recording switchback path 15 and the inversion path 16, and a path through which the paper is sent can be switched by the switching. Operations of the guide flaps 36 and 37 are also controlled by the control unit 27. In addition, the control unit 27 also controls transport timing when the belt transport means 20 and pairs of various transport rollers are driven.

When the double-sided recording is performed by the line head 10, the control unit 27 makes the paper of which the first surface is recorded wait for a predetermined wait time, and thereafter, inverts the paper, and performs recording on the second surface.

Specifically, recording on the first surface is performed (top diagram of FIG. 10), and the recorded paper (indicated by a symbol P in FIG. 10) is sent from the straight path 12 to the double-sided recording switchback path 15 (a second diagram from the top of FIG. 10).

In order to dry the recording on the first surface, the paper P waits for a predetermined wait time, in the double-sided recording switchback path 15.

The paper P (the second diagram from the top of FIG. 10) waited for the predetermined wait time in the double-sided recording switchback path 15 is sent in a direction (−Y-axis direction) opposite to the direction (+Y-axis direction) fed into the double-sided recording switchback path 15 by the pair of transport rollers 24 (FIG. 3) and enters into the inversion path 16, a record surface is inverted, the paper enters into the straight path 12 again, and recording is performed on the second surface by the line head 10 (the second diagram from the bottom of FIG. 10). In FIG. 3, a reference numeral 29 denotes a group of pairs of transport rollers provided in the inversion path 16.

The paper P having both surfaces on which recording is performed enters into the discharge path 13 which is an example of a transport destination from the straight path 12, is discharged from the first discharge unit 8, and is mounted on the medium mounting unit 9 (FIG. 3) (a bottom diagram in FIG. 10). When post-processing is performed in the post-processing mechanism unit 4, the sheet P having both surfaces on which recording is performed is sent from the straight path 12 to the delivery path 31.

Paper Feeding by Manual Feeding

The recording mechanism unit 2 (FIG. 3) is configured to be capable of feeding paper from a manual feeding tray 70 in addition to a case where the paper stored in the paper storage cassette 7 is fed and recording is performed. In FIG. 3, a dotted line R indicates a transport path in a case where paper is fed from the manual feeding tray 70.

The paper fed from the manual feeding tray 70 is sent by a pair of transport rollers 71, joined to the straight path 12, and recorded by the line head 10. In a case where double-sided recording is performed, recording is performed on the first surface, and thereafter, paper is inverted through the double-sided recording switchback path 15 and the inversion path 16, and recording is performed on the second surface.

The recorded paper is connected to the straight path 12, is transported through the second discharge path 74 that is linearly extended, and is mounted on a discharge tray 73 through the third discharge unit 72.

It is needless to say that the invention is not limited to the above-described embodiments, and various modifications can be made within the scope of the invention described in the aspects, and those are also included in the scope of the invention.

The entire disclosure of Japanese Patent Application No. 2017-089863, filed on Apr. 28, 2017 and No. 2017-097324, filed on May 16, 2017 are expressly incorporated by reference herein.

What is claimed is:

1. A recording system comprising:

a relay transport path through which a medium is transported between a recording unit that performs recording by ejecting liquid onto the medium and a post-processing unit that performs post-processing for the medium on which recording is performed by the recording unit, the relay transport path including a first transport path that is provided on an upstream side, a second transport path that is connected to the first transport path on a downstream side in a medium transport direction, and a third transport path that is connected to the second transport path on a downstream side in the medium transport direction;

a transport unit that transports the medium, which includes a preceding medium which is transported earlier and a succeeding medium which is transported subsequently to the preceding medium, through the relay transport path in the medium transport direction, the transport unit including first pairs of rollers disposed in the first transport path, second pairs of rollers disposed in the second transport path, and third pairs of rollers disposed in the third transport path; and a control unit configured to control the transport unit to transport, in the relay transport path, the preceding medium and the succeeding medium with an interval between a trailing edge of the preceding medium and a leading edge of the succeeding medium in the medium transport direction, the control unit being configured to control the transport unit to transport the preceding medium and the succeeding medium in the relay transport path such that the interval is widest in a transport region of the relay transport path, the transport region being located on a downstream side in the medium transport direction before the medium enters into the post-processing unit, in the relay transport path, and being closer to the post-processing unit than to the recording unit, the control unit being configured to control the transport unit such that an average medium transport speed in the third transport path by the third pairs of rollers is faster than an average medium transport speed in the second transport path by the second pairs of rollers, and such that the average medium transport speed in the second transport path by the second pairs of rollers is faster than an average medium transport speed in the first transport path by the first pairs of rollers.

2. The recording system according to claim 1, further comprising:

a correction transport unit that is provided in the relay transport path and to which a leading edge of the medium is butted to perform a skew correction operation and then to transport the medium, wherein the control unit is configured to control the transport unit to transport the preceding medium and the succeeding medium such that the interval is widest in the transport region that is arranged downstream relative to the correction transport unit in the medium transport direction.

3. The recording system according to claim 2, wherein the second transport path includes the correction transport unit.

4. The recording system according to claim 3, wherein the first transport path includes a branch path that is provided on an upstream side in the medium transport direction, a first switchback path that is one branch destination of the branch path and performs a switchback operation for reversing a transport direction of the medium, a second switchback path that is another branch destination of the branch path and performs a switchback operation for reversing the transport direction of the medium, a first inversion path through which the medium after the switchback operation in the first switchback path is sent, a second inversion path through which the medium after the switchback operation in the second switchback path is sent, and a confluence path in which the first inversion path and the second inversion path are joined and which is connected to the second transport path.

5. The recording system according to claim 3, wherein the control unit is configured to control the transport unit such that the interval when the trailing edge of the preceding medium is located at a position of a pair of downstream side transport rollers that is located on a most downstream side among the second pairs of rollers is wider than the interval when a leading edge of the preceding medium is located at a position of a pair of upstream side transport rollers that is located at a most upstream side among the second pairs of rollers.

6. The recording system according to claim 2, wherein the correction transport unit is arranged downstream relative to the recording unit and upstream relative to the post-processing unit in the medium transport direction, and the control unit is configured to control the transport unit to transport the preceding medium and the succeeding medium such that the interval is widest in the transport region that is arranged downstream relative to the correction transport unit and upstream relative to the post-processing unit in the medium transport direction.

7. The recording system according to claim 1, further comprising:

a recording mechanism unit that includes the recording unit;

a post-processing mechanism unit that includes the post-processing unit; and a relay mechanism unit that is disposed between the recording mechanism unit and the post-processing mechanism unit and includes at least a part of the relay transport path.

8. The recording system according to claim 1, wherein the control unit is configured to control transport speed of the transport unit such that the interval is widest in the transport region.

9. A recording system comprising:

a relay transport path through which a medium is transported between a recording unit that performs recording by ejecting liquid onto the medium and a post-processing unit that performs post-processing for the medium on which recording is performed by the recording unit, the relay transport path including a first transport path that is provided on an upstream side and has a switchback path, a second transport path that is connected to the first transport path on a downstream side in a medium transport direction and has a skew correction operation area, and a third transport path that is connected to the second transport path on a downstream side in the medium transport direction and is placed in the post-processing unit;

a transport unit that transports the medium, which includes a preceding medium which is transported earlier and a succeeding medium which is transported subsequently to the preceding medium, through the relay transport path in the medium transport direction; and a control unit configured to control the transport unit to transport, in the relay transport path, the preceding medium and the succeeding medium with an interval between a trailing edge of the preceding medium and a leading edge of the succeeding medium in the medium transport direction, the control unit being configured to control the transport unit such that an average medium transport speed in the third transport path is faster than an average medium transport speed in the second transport path, and the average medium transport speed in the second transport path is faster than an average medium transport speed in the first transport path.

* * * * *